US009129538B2

(12) United States Patent
Maier-Hunke

(10) Patent No.: US 9,129,538 B2
(45) Date of Patent: Sep. 8, 2015

(54) NAME BADGE

(75) Inventor: Horst-Werner Maier-Hunke, Iserlohn (DE)

(73) Assignee: Durable Hunke & Jocheim GmbH & Co. KG, Iserlohn (DE)

( * ) Notice: Subject to any disclaimer, the term of this patent is extended or adjusted under 35 U.S.C. 154(b) by 1726 days.

(21) Appl. No.: 11/992,461

(22) PCT Filed: Sep. 16, 2006

(86) PCT No.: PCT/EP2006/009038

§ 371 (c)(1),
(2), (4) Date: Mar. 20, 2009

(87) PCT Pub. No.: WO2007/033803

PCT Pub. Date: Mar. 29, 2007

(65) Prior Publication Data

US 2009/0217558 A1 Sep. 3, 2009

(30) Foreign Application Priority Data

Sep. 22, 2005 (DE) ..... 10 2005 046 469

(51) Int. Cl.
*A44C 3/00* (2006.01)
*G09F 3/20* (2006.01)

(52) U.S. Cl.
CPC ..... *G09F 3/207* (2013.01)

(58) Field of Classification Search
CPC ..... G09F 3/207
USPC ..... 40/1.6, 1.5; 24/3.11, 3.12
See application file for complete search history.

(56) References Cited

U.S. PATENT DOCUMENTS

| | | | | | |
|---|---|---|---|---|---|
| 1,281,656 | A | * | 10/1918 | Raschick | 24/3.12 |
| 2,609,629 | A | | 9/1952 | Hubbard | |
| 5,052,081 | A | * | 10/1991 | Fuehrer | 24/35 |
| 5,291,768 | A | * | 3/1994 | Rieffel et al. | 70/460 |
| 5,406,726 | A | | 4/1995 | Fan | |
| 5,504,976 | A | * | 4/1996 | Reeves | 24/3.1 |
| 5,592,767 | A | * | 1/1997 | Treske | 40/649 |
| 2003/0101630 | A1 | | 6/2003 | Garcia et al. | |

FOREIGN PATENT DOCUMENTS

| | | | |
|---|---|---|---|
| DE | 284049 | A | 5/1915 |
| DE | 8901912 | U1 | 6/1989 |
| DE | 10104312 | A1 | 8/2002 |
| FR | 2605127 | | 4/1988 |

* cited by examiner

*Primary Examiner* — Kristina Junge
(74) *Attorney, Agent, or Firm* — Mark P. Stone

(57) ABSTRACT

On a name badge, the rear part (2) of which, formed as a plastic injection moulded part, has a hook-shaped clamping limb (10) for the attachment of the name badge to an item of clothing, the clamping limb (10) is provided with a slot (14) into which an abutment (15) projects to improve the seating of the name badge on the item of clothing.

12 Claims, 2 Drawing Sheets

NAME BADGE

TECHNICAL FIELD

The invention relates to a name badge with a front part and a rear part, in which the front part and the rear part form a receptacle for a label and in which the rear part is provided with a devices formed as a plastic injection moulded part, which has a hook-shaped clamping limb, for the attachment of the name badge to an item of clothing.

STATE OF THE ART

From DE 101 04 312 A1 a name badge of the above type is known with a comparatively wide hook-shaped clamping limb, which presses with its free end against a mounting plate which is detachably connected to the rear part of the name badge and which forms one piece with the clamping limb. With this known name badge the clamping force of the clamping limb is limited in relationship to the clamping force of attachment devices which—as known from DE 89 01 912 U1—are formed as a crocodile clip. In order to improve the seating of the name badge known from DE 101 04 312 A1 on the item of clothing, the front part of this name badge is provided with teeth orientated to the rear and its rear part is provided with a rear wall adapted to the contour of the teeth, the said rear wall also having at the sides a curved shape orientated towards the rear in order to ensure adequate contact between the side edges of the name badge and the respective item of clothing. In spite of all this, the effort in realising a flawless seating of the known name badge is comparatively high. Finally, from DE 28 40 49 A a metal clamp is known, which can be attached by a bending process at the edge of a label consisting of cardboard, with a clamping limb, the clamp ing effect of which is increased by a tongue pressing against its rear side.

DESCRIPTION OF THE INVENTION

Since name badges represent mass-produced articles, which are often used only once for a certain event, the reduction of their manufacturing costs takes on substantial significance. The object of the invention is therefore to provide a name badge of the type under consideration, the flawless seating of which on an item of clothing can be realised in a simpler manner than with the known name badge. This object is solved according to the invention in that the clamping limb of the attachment device of the name badge has a slot into which an abutment projects to increase the clamping effect. With the name badge according to the invention the material of the item of clothing to which it is attached is not primarily pressed by the clamping limb against an adjacent surface, but is rather camped in the gap between the abutment and the edges of the slot in the clamping limb. The material is here deformed into a slight U-shape in the region of the attachment device.

The seating of the name badge on the item of clothing can still be improved in that the clamping limb is arranged between two side ridges, which force the cloth the attachment region to assume an undulated shape, wherein it has proven to be particularly practical if the abutment and the side ridges have a curved contour and the peaks of their contours protruding above the rear wall of the rear part at least partially overlap the peak of an oppositely orientated contour of the clamping limb at the sides in the clamping range.

Further features and details of the invention arise from the dependent claims as well as the enclosed drawings and their following description.

BRIEF DESCRIPTION OF THE DRAWINGS

The following are shown.

Figure 1:
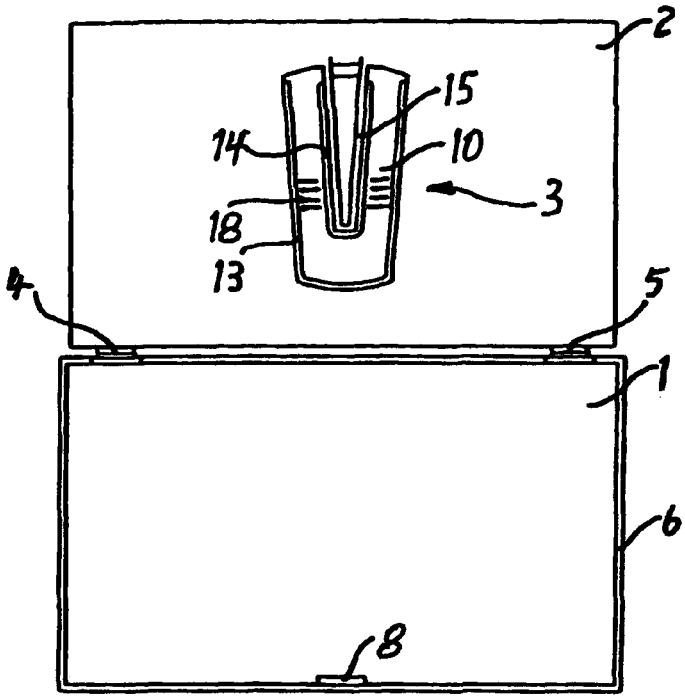
FIG. 1 the plan view of the inner sides of an open name badge, the rear part of which is provided with an integral means of attachment, FIG. 2 the side view of the name badge according to FIG. 1, FIG. 3 the plan view onto the outer sides of the open name badge according to FIGS. 1 and 2, FIG. 4 a section along the line IV-IV in FIG. 3, FIG. 5 the plan view onto the rear part of the closed name badge according to FIGS. 1 to 4, FIG. 6 a section along the line VI-VI in FIG. 5 and FIG. 7 the perspective view of the closed name badge according to FIGS. 1 to 6.

In the figures the front part of a name badge is designated with 1 and the rear part with 2, an attachment device 3 being used to attach the said badge to an item of clothing. The front part 1 is connected to the rear part 2 by two pivot bearings 4 and 5 formed by film hinges. The front part 1, rear part 2, attachment device 3 and the pivot bearings 4, 5 are composed of one piece, formed as an injection moulded component.

To increase the stiffness of the name badge both the front part 1 and also the rear part 2 are slightly curved and are in addition provided with circumferential ridges 6 or 7, wherein the height H of the ridge 6 is greater than the height h of the ridge 7 in order to prevent protrusion of the ridge 7 beyond the ridge 6 when the name badge is closed. The ridge 6 of the front part 1 forms a frame not only for the rear part 2, but also for a label, not shown, which consequently cannot be lost To ensure that the closed parts 1 and 2 keep together a latching connection is used which consists of a hook 8 and a cavity-shaped recess 9, behind which the tip of the hook 8 can engage.

Figure 6:
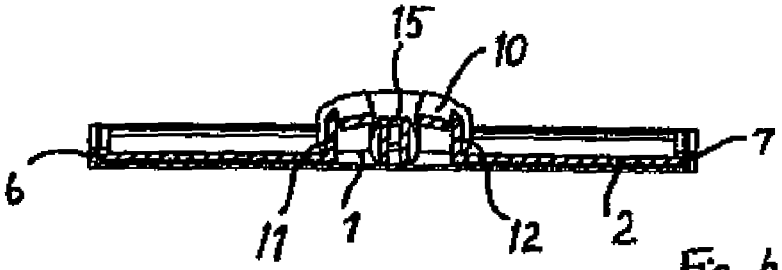
Figure 5:
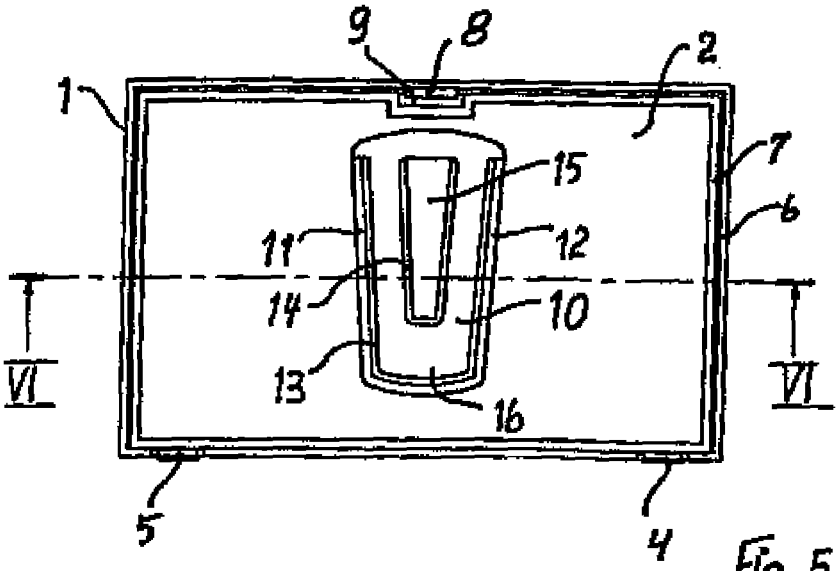

The attachment device 3 has a clamping limb 10, which can be used as an attachment element and is formed as a type of hook, and to which ridges 11, 12 are assigned at the side which delimit a recess 13 in the region of which the clamping limb 10 is arranged. During the attachment of the name badge to an item of clothing, the cloth of the item of clothing is firmly clamped between the clamping limb 10 and the side ridges 11, 12. In the case of dispensing with the side ridges 11, 12 or also increasing the clamping effect it is found to be practicable to provide the clamping limb 10 with a central slot 14 into which an abutment 15 with a U-shaped cross-section, recognisable in FIG. 6, protrudes.

When attaching the name badge to an item of clothing the cloth of the item of clothing is firmly clamped by the clamping limb 10 of the attachment device 3 in the gaps between the side ridges 11, 12 and the clamping limb 10 and also in the gaps between the clamping limb 10 and the abutment 15, so that the cloth takes on an undulated shape in the attachment device 3.

Figure 2:
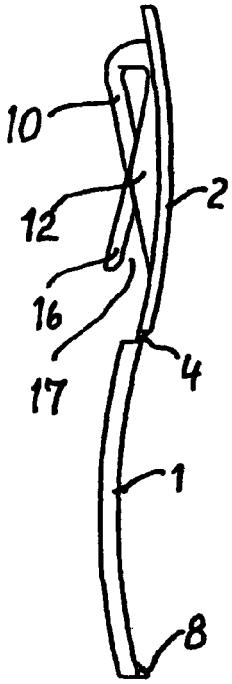
Figure 4:
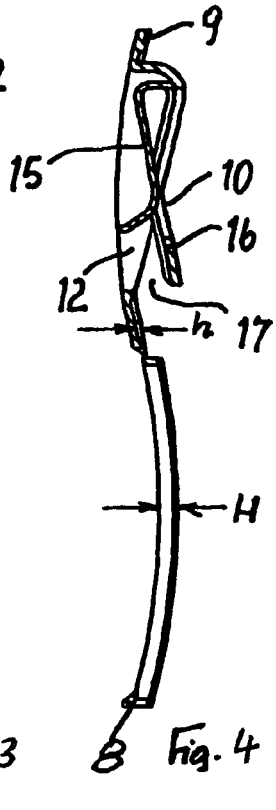
Figure 7:
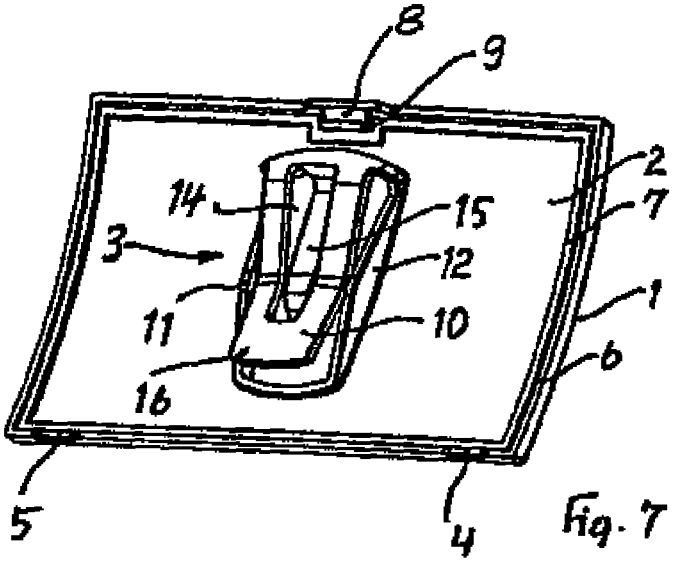

In order to simplify attaching the name badge to an item of clothing, the free end 16 of the clamping limb 10, the abutment 15 and the side ridges 11, 12 essentially form a V-shaped insertion gap 17 as viewed from the side, i.e. as can be seen in FIGS. 2 and 4.

Figure 3:
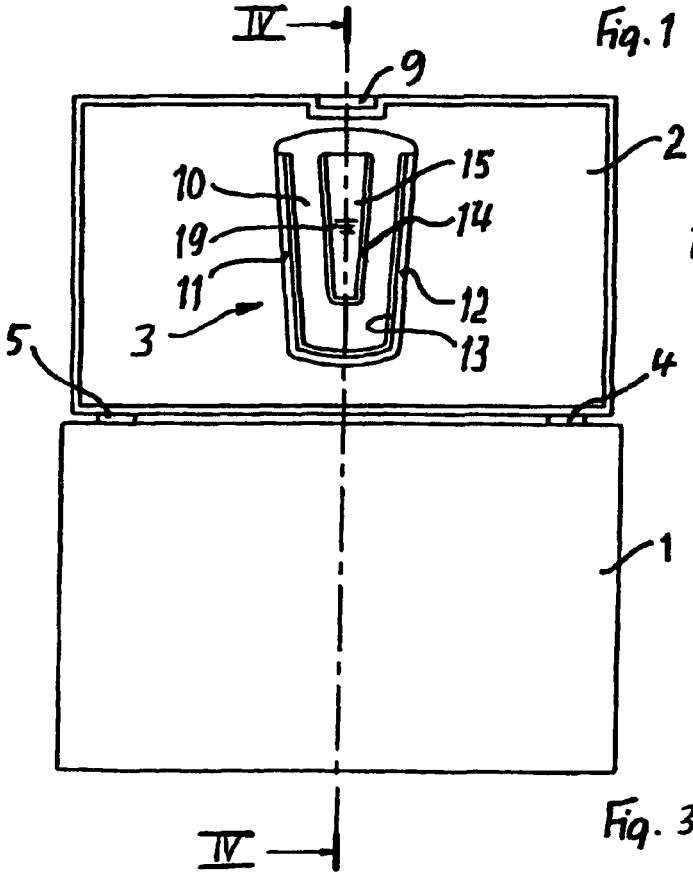

Due to the realisation of the attachment device as an injection moulded part the sides of the clamping limb 10 and the abutment 15 orientated towards one another can be easily provided with an irregular surface structure, as indicated by the ribbing 18 and 19 in FIGS. 1 and 3.

The invention claimed is:

1. Name badge with a front part (1) and a rear part (2), in which the front part (1) and the rear part (2) form a receptacle for a label and in which the rear part (2) is provided with a device (3), formed as a plastic injection moulded part, which has a hook-shaped clamping limb (10), for the attachment of the name badge to an item of clothing, characterised in that the clamping limb (10) has a slot (14) into which an abutment (15) projects to increase the clamping effect, that said name badge and said clamping limb are integrally formed as one piece, that said front part (1) is connected to said rear part (2) by at least one pivot bearing (4, 5) formed by a film hinge, and that the sides of the clamping limb (10) and the abutment (15) orientated towards one another are provided with a surface structure to improve the seating of the name badge at the respective item of clothing; wherein said clamping limb (10) is disposed between two side ridges (11, 12) extending in a direction substantial the same as the direction of extension of said clamping limb (10); said two side ridges defining slots between opposed lateral sides of said clamping limb (10), respectively, for receiving therein a portion of the item of clothing to which said name badge is attached.

2. Name badge according to claim 1, wherein the abutment (15) and the side ridges (11, 12) have a curved contour with peaks, the peaks of said contours projecting above a rear wall of the rear part (2) at least partially overlap a peak of an oppositely orientated contour of the clamping limb (10) at a side in the clamping range of the clamping limb.

3. Name badge according to claim 2, characterised in that, viewed from the side of the name badge, a free end (16) of the clamping limb (10), the abutment (15) and the side ridges (11, 12) delimit a V-shaped insertion gap (17) for an edge section of an item of clothing.

4. Name badge according to claim 3, characterised in that the device (3) forms an integrated component of the rear part (2).

5. Name badge according to claim 2, characterised in that the device (3) forms an integrated component of the rear part (2).

6. Name badge according to claim 1, characterised in that the sides of said clamping limb (10) and said abutment (15) orientated towards one another have a ribbing (18, 19).

7. Name badge according to claim 6, characterised in that the device (3) forms an integrated component of the rear part (2).

8. Name badge according to claim 1, characterised in that the device (3) forms an integrated component of the rear part (2).

9. Name badge according to claim 6, characterised in that said attachment device (3) is formed integrally with said rear part (2) as a plastic injection moulded part.

10. Name badge with a front part (1) and a rear part (2), in which the front part (1) and the rear part (2) form a receptacle for a label and in which the rear part (2) is provided with a device (3), formed as a plastic injection moulded part, which has a hook-shaped clamping limb (10), for the attachment of the name badge to an item of clothing, characterised in that the clamping limb (10) has a slot (14) into which an abutment (15) projects to increase the clamping effect, that said name badge and said clamping limb are integrally formed as one piece, that said front part (1) is connected to said rear part (2) by two pivot bearings (4, 5) formed by film hinges, and that the sides of the clamping limb (10) and the abutment (15) orientated towards one another are provided with a surface structure to improve the seating of the name badge at the respective item of; wherein said clamping limb (10) is disposed between two side ridges (11,12) extending in a direction substantially the same as the direction of extension of said clamping limb (10); said two side ridges defining slots between opposed lateral sides of said clamping limb (10), respectively, for receiving therein a portion of the item of clothing to which said name badge is attached.

11. Name badge according to claim 10, characterised in that the sides of said clamping limb (10) and said abutment (15) orientated towards one another have a ribbing (18, 19).

12. Name badge according to claim 10, characterised in that the device (3) forms an integrated component of the rear part (2).

* * * * *

UNITED STATES PATENT AND TRADEMARK OFFICE

CERTIFICATE OF CORRECTION

PATENT NO. : 9,129,538 B2
APPLICATION NO. : 11/992461
DATED : September 8, 2015
INVENTOR(S) : Horst-Werner Maier-Hunke It is certified that error appears in the above-identified patent and that said Letters Patent is hereby corrected as shown below:

In the claims

Claim 9, Line 1 (Column 4, Line 10): Delete “claim 6” and substitute --claim 1--.

Claim 10, Line 15 (Column 4, Line 27): After “respective item of”, add --clothing--.

Signed and Sealed this
Fifth Day of January, 2016

Michelle K. Lee

Michelle K. Lee
*Director of the United States Patent and Trademark Office*